US008385770B2

(12) United States Patent
Yamada et al.

(10) Patent No.: US 8,385,770 B2
(45) Date of Patent: Feb. 26, 2013

(54) DEVELOPER RECOVERY DEVICE AND IMAGE FORMING DEVICE

(75) Inventors: Masatoshi Yamada, Kanagawa (JP); Yoshihiro Enomoto, Kanagawa (JP); Katsuya Takenouchi, Kanagawa (JP); Katsunori Kikuchihara, Kanagawa (JP); Yoshihisa Nakao, Kanagawa (JP); Kazuyuki Yagata, Kanagawa (JP); Kiyotoshi Kaneyama, Kanagawa (JP); Kenji Suzuki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 115 days.

(21) Appl. No.: 12/951,823

(22) Filed: Nov. 22, 2010

(65) Prior Publication Data

US 2011/0236053 A1 Sep. 29, 2011

(30) Foreign Application Priority Data

Mar. 26, 2010 (JP) ..... 2010-073496

(51) Int. Cl.
*G03G 15/16* (2006.01)

(52) U.S. Cl. ..... 399/101

(58) Field of Classification Search ..... 399/98, 399/99, 123, 343, 358
See application file for complete search history.

(56) References Cited

FOREIGN PATENT DOCUMENTS

| | | | |
|---|---|---|---|
| JP | 04309739 A | * | 11/1992 |
| JP | 6-324611 | | 11/1994 |
| JP | 2002-278312 | | 9/2002 |

OTHER PUBLICATIONS

Machine translation of Naoto (JP 2002278312 A). Publication date, Sep. 27, 2002.*
Machine translation of Masahito (JP 06-324611 A). Publication date, Nov. 25, 1994.*

* cited by examiner

*Primary Examiner* — Walter L Lindsay, Jr.
*Assistant Examiner* — Frederick Wenderoth
(74) *Attorney, Agent, or Firm* — Sughrue Mion, PLLC

(57) ABSTRACT

There is provided a developer recovery device including: a casing; a recovery member disposed along an edge portion of the aperture portion; a sealing member disposed along an edge portion at a conveyance direction upstream side of the aperture portion; a moving section that moves the recovery member and the sealing member between a position of being touched against the developer-bearing member and a position of being apart from the developer-bearing member; a suction section that sucks the developer separated from the developer-bearing member into the casing; and a filter that is long in the length direction of the aperture portion and that is disposed in the casing between the aperture portion and the suction section with an inclination such that a lower portion of the filter is further away from the aperture portion than an upper portion of the filter.

6 Claims, 11 Drawing Sheets

DEVELOPER RECOVERY DEVICE AND IMAGE FORMING DEVICE

CROSS-REFERENCE TO RELATED APPLICATION

This application is based on and claims priority under 35 USC 119 from Japanese Patent Application No. 2010-073496 filed on Mar. 26, 2010.

BACKGROUND

Technical Field

The present invention relates to a developer recovery device and an image forming device.

SUMMARY

According to an aspect of the invention, there is provided a developer recovery device including:

a casing at which an aperture portion is formed, the aperture portion being disposed to oppose a developer-bearing member that retains and conveys a developer while turning, and the aperture portion being long in a direction orthogonal to a conveyance direction of the developer-bearing member;

a recovery member that is disposed along an edge portion of the aperture portion so as to touch against the developer bearing member, the edge portion being at a downstream side of the aperture portion in the conveyance direction, and the recovery member separating the developer from an outer peripheral face of the developer-bearing member and recovering the developer into the casing;

a sealing member that is disposed along an edge portion at a conveyance direction upstream side of the aperture portion so as to touch the developer-bearing member and that seals a gap between the casing and the developer-bearing member;

a moving section that moves the recovery member and the sealing member between a position of being touched against the developer-bearing member and a position of being apart from the developer-bearing member;

a suction section that sucks the developer separated from the developer-bearing member into the casing; and a filter that is long in the length direction of the aperture portion and that is disposed in the casing between the aperture portion and the suction section with an inclination such that a lower portion of the filter is further away from the aperture portion than an upper portion of the filter.

BRIEF DESCRIPTION OF THE DRAWINGS

Exemplary embodiments of the present invention will be described in detail based on the following figures, wherein.

DETAILED DESCRIPTION

Examples of a developer recovery device and an image forming device relating to an exemplary embodiment of the present invention will be described.

Figure 1:
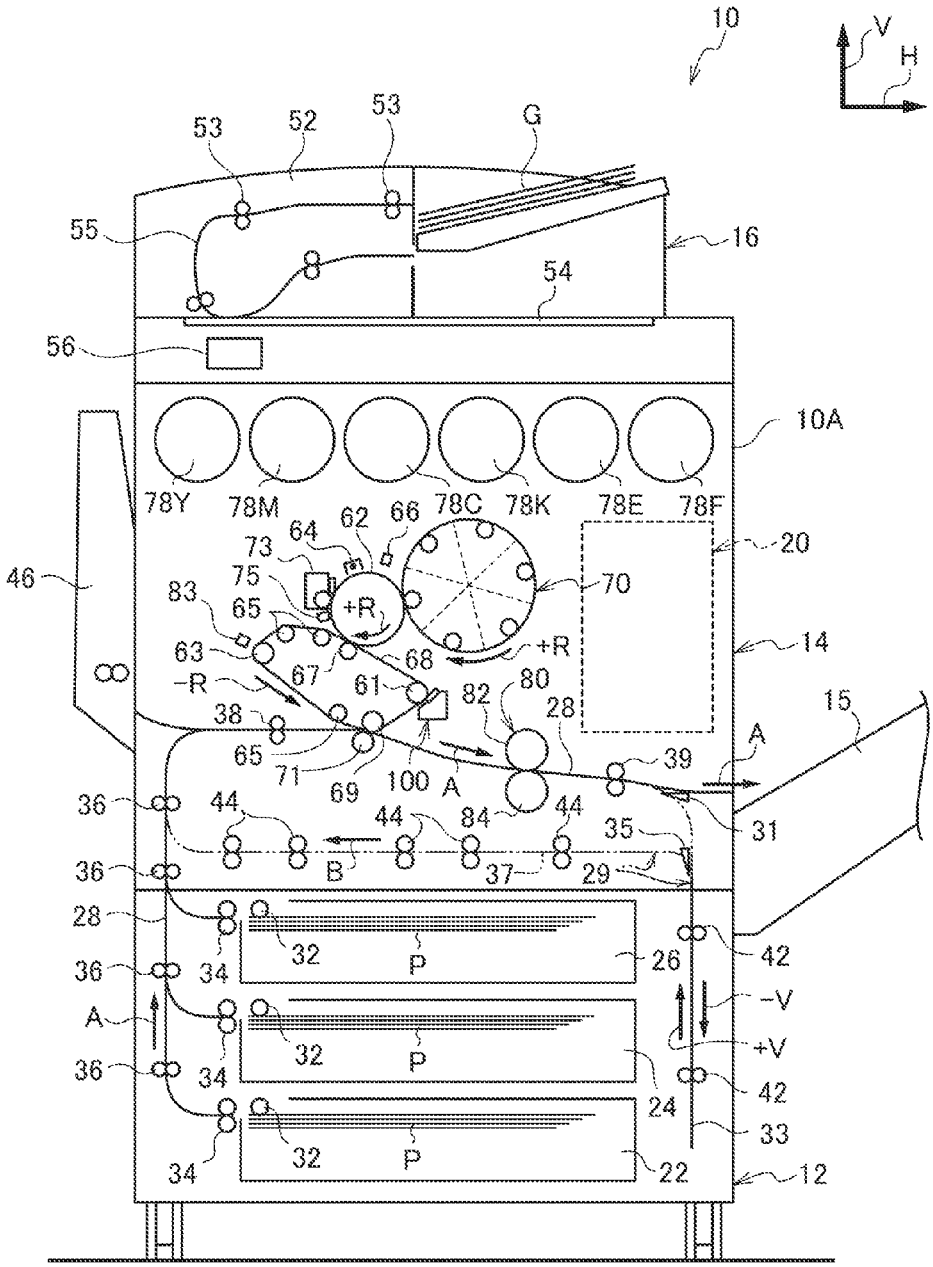
FIG. 1 is an overall structural diagram of an image forming device relating to an exemplary embodiment of the present invention.

FIG. 1 illustrates an image forming device 10 that serves as an example of the present exemplary embodiment. The image forming device 10 is structured to include, from the lower side to the upper side in a vertical direction (the direction of arrow V), a paper accommodation section 12, an image forming section 14, an original document reading section 16 and a control section 20. The paper accommodation section 12 accommodates recording paper P. The image forming section 14 is provided above the paper accommodation section 12 and carries out image formation on recording paper P that has been supplied from the paper accommodation section 12. The original document reading section 16 is provided above the image forming section 14 and reads reading original documents G. The control section 20 is disposed in the image forming section 14 and controls operations of respective sections of the image forming device 10. In the descriptions hereinafter, the vertical direction of a device main body 10A of the image forming device 10 is represented by the direction of arrow V and a horizontal direction of the same is represented by the direction of arrow H.

The paper accommodation section 12 is provided with a first accommodation portion 22, a second accommodation portion 24 and a third accommodation portion 26, in which recording papers P of different sizes, which are examples of recording mediums, are accommodated. Feedout rollers 32, which feed out the accommodated recording paper P to a conveyance path 28 provided in the image forming device 10, are provided at the first accommodation portion 22, the second accommodation portion 24 and the third accommodation portion 26. Respective pairs of conveyance rollers 34 and conveyance rollers 36, which convey the recording paper P one sheet at a time, are provided at a downstream side of the conveyance path 28 relative to the feedout rollers 32. A positioning roller 38 is provided at the downstream side of the conveyance path 28 in the conveyance direction of the recording paper P relative to the conveyance rollers 36. The positioning roller 38 temporarily stops the recording paper P, and feeds the recording paper P to a below-described secondary transfer position at a specified timing.

An upstream side portion of the conveyance path 28 is provided in a straight line in the direction of arrow V from the left side of the paper accommodation section 12 in a front view of the image forming device 10 to a left side lower portion of the image forming section 14. A downstream side portion of the conveyance path 28 is provided from the left side lower portion of the image forming section 14 to an ejection section 15 that is provided at a right side face of the image forming section 14. A two-sided printing conveyance path 29 is connected to the conveyance path 28. The two-sided printing conveyance path 29 conveys and inverts the recording paper P in order for image formation to be performed on both faces of the recording paper P.

The two-sided printing conveyance path 29 includes a first switching member 31, an inversion portion 33, a conveyance portion 37, and a second switching member 35. The first switching member 31 switches between the conveyance path 28 and the two-sided printing conveyance path 29. The inversion portion 33 is provided in a straight line in the direction of arrow V from a right side lower portion of the image forming section 14 to the right side of the paper accommodation section 12. The conveyance portion 37, into which a trailing end of recording paper P that has been conveyed along the inversion portion 33 enters first, conveys the recording paper P in the direction of arrow H. The second switching member 35 switches between the inversion portion 33 and the conveyance portion 37. Pairs of conveyance rollers 42 are provided at the inversion portion 33, spaced apart at a plural number of locations. Pairs of conveyance rollers 44 are provided at the conveyance portion 37, spaced apart at a plural number of locations.

The first switching member 31 is a triangular rod member, and switches the conveyance direction of the recording paper P by a distal end portion thereof being moved to one or other of the conveyance path 28 and the two-sided printing conveyance path 29 by an unillustrated moving section. Similarly, the second switching member 35 is a rod member that is triangular in front view, and switches the conveyance direction of the recording paper P by a distal end portion thereof being moved to one or other of the inversion portion 33 and the conveyance portion 37 by an unillustrated moving section. A downstream side end portion of the conveyance portion 37 is connected by an unillustrated guide member to a near side of the conveyance rollers 36 at the upstream side portion of the conveyance path 28. Meanwhile, a folding-type manual paper supply section 46 is provided at a left side face of the image forming section 14. The manual paper supply section 46 is connected to a near side of the positioning roller 38 on the conveyance path 28.

The original document reading section 16 is provided with an original document conveyance device 52, a platen glass 54 and an original document reading device 56. The original document conveyance device 52 automatically conveys reading originals G one sheet at the time. The platen glass 54 is disposed downstream of the original document conveyance device 52, and one sheet of a reading original G is placed on the platen glass 54. The original document reading device 56 reads a reading original G conveyed by the original document conveyance device 52 or a reading original G placed on the platen glass 54. The original document conveyance device 52 includes an automatic conveyance path 55 along which pairs of conveyance rollers 53 are plurally disposed. A portion of the automatic conveyance path 55 is disposed such that the reading originals G pass over the platen glass 54. The original document reading device 56 reads a reading original G that is conveyed by the original document conveyance device 52 in a state in which the reading original G is stopped at the left side of the platen glass 54, or the original document reading device 56, while moving in the direction of arrow H, reads a reading original G that has been placed on the platen glass 54.

The image forming section 14 is provided with a cylindrical photoreceptor 62 which serves as an example of a latent image-bearing body, at the middle of the device main body 10A. The photoreceptor 62 is rotated in the direction of arrow +R (the clockwise direction in the drawing) by an unillustrated movement section and retains an electrostatic latent image that is formed by light illumination. A corotron-type charging member 64, which charges up the surface of the photoreceptor 62, is provided at a position above the photoreceptor 62, opposing an outer peripheral face of the photoreceptor 62.

An exposure device 66 is disposed at a position at the downstream side of the rotation direction of the photoreceptor 62 relative to the charging member 64, opposing the outer peripheral face of the photoreceptor 62. The exposure device 66 is structured with LEDs (light emitting diodes), illuminates (exposes) light based on image signals corresponding to respective toner colors onto the outer peripheral face of the photoreceptor 62 that has been charged up by the charging member 64, and forms electrostatic latent images. The exposure device 66 is not limited to an LED system and may, for example, scan laser light with a polygon mirror.

A rotary switching-type developing device 70 is disposed at the downstream side of the rotation direction of the photoreceptor 62 relative to a position that is illuminated with exposure light from the exposure device 66. The developing device 70 serves as an example of a developing section that develops electrostatic latent images formed on the outer peripheral face of the photoreceptor 62 with toners of specified colors and makes the images visible. Details of the developing device 70 are described below.

An intermediate transfer belt 68 is disposed at the downstream side of the direction of rotation of the photoreceptor 62 relative to the developing device 70, at the lower side of the photoreceptor 62. The intermediate transfer belt 68 serves as an example of a developer-bearing member to which the toner image formed on the outer peripheral face of the photoreceptor 62 is transferred. The intermediate transfer belt 68 is endless, and is wound round a driving roller 61, a tension application roller 63, plural conveyance rollers 65, and an auxiliary roller 69. The driving roller 61 is driven to turn by the control section 20. The tension application roller 63 is for applying tension to the intermediate transfer belt 68. The conveyance rollers 65 touch against a rear face of the intermediate transfer belt 68 and turn to follow the intermediate transfer belt 68. The auxiliary roller 69 touches against the rear face of the intermediate transfer belt 68 at the secondary transfer position, which is described below, and turns to follow the intermediate transfer belt 68. The intermediate transfer belt 68 moves to turn in the direction of arrow –R (the counter-clockwise direction in the drawing) due to rotation by the driving roller 61.

A primary transfer roller 67 is disposed to sandwich the intermediate transfer belt 68 at the opposite side thereof from the photoreceptor 62. The primary transfer roller 67 causes a toner image formed on the outer peripheral face of the photoreceptor 62 to be primary transferred onto the intermediate transfer belt 68. The primary transfer roller 67 touches against the rear face of the intermediate transfer belt 68 at a position separated to the downstream side in the direction of movement of the intermediate transfer belt 68 from the position at which the photoreceptor 62 and the intermediate transfer belt 68 touch. The primary transfer roller 67 is electrically powered from an unillustrated power source, and thus primary transfers the toner image on the photoreceptor 62 onto the intermediate transfer belt 68 with a potential difference from the photoreceptor 62, which is grounded.

A secondary transfer roller 71 is disposed to sandwich the intermediate transfer belt 68 at the opposite side thereof from the auxiliary roller 69. The secondary transfer roller 71 serves as an example of a transfer section that causes the toner image that has been primary transferred onto the intermediate transfer belt 68 to be secondary transferred onto the recording paper P. A portion between the secondary transfer roller 71 and the auxiliary roller 69 serves as the secondary transfer position at which the toner image secondary transfers onto the recording paper P. The secondary transfer roller 71 touches against a surface of the intermediate transfer belt 68. The secondary transfer roller 71 is electrically powered from an unillustrated power source, and thus secondary transfers the toner image on the intermediate transfer belt 68 onto the recording paper P with a potential difference from the auxiliary roller 69, which is grounded.

A cleaning device 100 is disposed to sandwich the intermediate transfer belt 68, at the opposite side thereof from the driving roller 61. The cleaning device 100 serves as a developer recovery device that recovers remaining toner on the intermediate transfer belt 68 after the secondary transfer. Details of the cleaning device 100 are described below. Meanwhile, a position detection sensor 83 is disposed at a position that opposes the tension application roller 63 at the periphery of the intermediate transfer belt 68. The position detection sensor 83 detects a pre-specified reference position on the intermediate transfer belt 68 by detecting a mark (not illustrated) applied to the surface of the intermediate transfer belt 68. The position detection sensor 83 outputs a position detection signal, which is a reference for a start timing of image formation processing.

A cleaning device 73 is disposed at the downstream side of the direction of rotation of the photoreceptor 62 relative to the primary transfer roller 67. The cleaning device 73 cleans off remaining toner and the like that is not primary transferred to the intermediate transfer belt 68 but remains on the surface of the photoreceptor 62. The cleaning device 73 is a structure that recovers the remaining toner and the like with a cleaning blade and a brush roller that touch against the surface of the photoreceptor 62. A charge elimination device 75 is provided at the upstream side of the cleaning device 73 in the direction of rotation of the photoreceptor 62 (the downstream side relative to the primary transfer roller 67). The charge elimination device 75 illuminates light onto the outer peripheral face of the photoreceptor 62 and charge-eliminates the same. The charge elimination device 75 is for reducing adhesiveness due to static electricity, by illuminating light at the outer peripheral face of the photoreceptor 62 and charge-eliminating the same before the recovery of the remaining toner and the like by the cleaning device 73, thus increasing a proportion of recovery of the remaining toner and the like. Another charge elimination section may be provided subsequent to the recovery of the remaining toner and the like at the downstream side of the cleaning device 73 and the upstream side of the charging member 64.

The secondary transfer position of toner images by the secondary transfer roller 71 is set partway along the aforementioned conveyance path 28. A fixing device 80 is provided on the conveyance path 28 at the downstream side of the direction of conveyance of the recording paper P (arrow A in the drawing) relative to the secondary transfer roller 71. The fixing device 80 fixes the toner image to the recording paper P to which the toner image has been transferred by the secondary transfer roller 71. The fixing device 80 is structured with a heating roller 82 and a pressure roller 84. The heating roller 82 is disposed at the toner image face side (upper side) of the recording paper P, and includes a heat source that is heated by being electrically powered. The pressure roller 84 is disposed at the lower side of the heating roller 82 and presses the recording paper P against the outer peripheral face of the heating roller 82. Conveyance rollers 39 are provided on the conveyance path 28 at the downstream side of the direction of conveyance of the recording paper P relative to the fixing device 80. The conveyance rollers 39 convey the recording paper P toward the ejection section 15 or the inversion portion 33.

Toner cartridges 78Y, 78M, 78C, 78K, 78E and 78F are replaceably provided in a row in the horizontal direction at the lower side of the original document reading device 56, at the upper side relative to the developing device 70. The toner cartridges 78Y, 78M, 78C, 78K, 78E and 78F accommodate toners of yellow (Y), magenta (M), cyan (C), black (K), a first spot color (E) and a second spot color (F). The first spot color E and the second spot color F are selected from spot colors (including transparent) other than yellow, magenta, cyan and black, or may not be selected. If the first spot color E and the second spot color F are selected, image formation with the six colors Y, M, C, K, E and F is carried out at the developing device 70, and if the first spot color E and the second spot color F are not selected, image formation with the four colors Y, M, C and K is carried out at the developing device 70. In the present exemplary embodiment, as an example, a case is described in which image formation is performed with the four colors Y, M, C and K, and the first spot color E and second spot color F are not used. As another example, images may be formed with five colors using the four colors Y, M, C and K and the first spot color E or the second spot color F.

Next, the developing device 70 is described.

Figure 2:
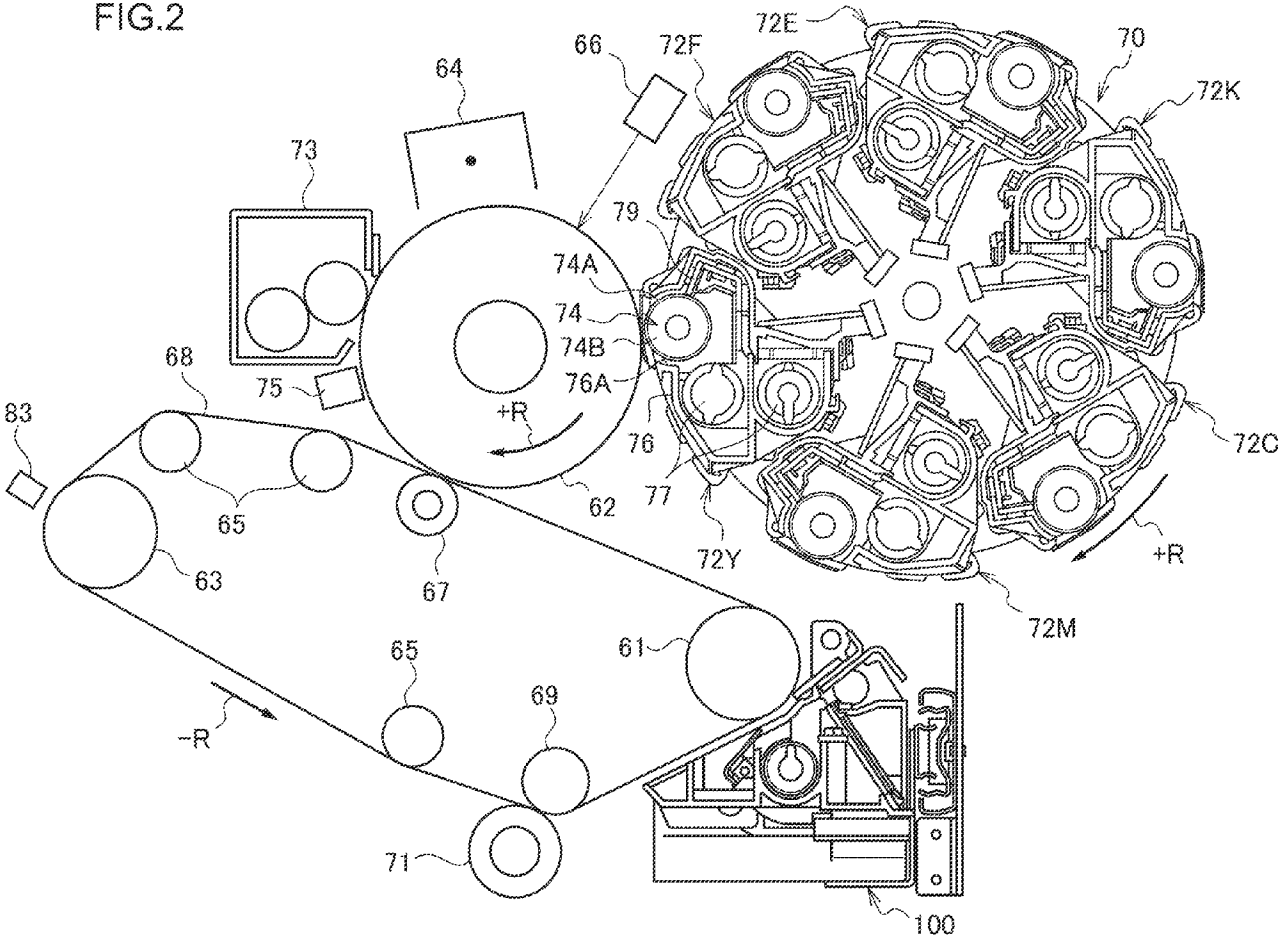
FIG. 2 is a structural diagram of an image forming section relating to the exemplary embodiment of the present invention.

As illustrated in FIG. 2, in the developing device 70, developing units 72Y, 72M, 72C, 72K, 72E and 72F corresponding to the toner colors yellow (Y), magenta (M), cyan (C), black (K), the first spot color (E) and the second spot color (F), respectively, are arranged in a circumferential direction (in this order in the counter-clockwise direction). The developing units 72Y, 72M, 72C, 72K, 72E and 72F that are to perform image processing are switched between so as to oppose the outer peripheral face of the photoreceptor 62, by rotations of 60° about the center of the developing device 70 by a motor that is a rotation section. Herein, because the developing units 72Y, 72M, 72C, 72K, 72E and 72F have the same structure, the developing unit 72Y is described here and descriptions are not given for the other developing units 72M, 72C, 72K, 72E and 72F.

The developing unit 72Y includes a case member 76 as a main body. A developer (not illustrated), formed of a toner and a carrier, that is supplied through a toner supply channel (not illustrated) is charged into the case member 76 from the toner cartridge 78Y. A rectangular aperture portion 76A is formed in the case member 76 to oppose the outer peripheral face of the photoreceptor 62. A developing roller 74 whose outer peripheral face opposes the outer peripheral face of the photoreceptor 62 is disposed at the aperture portion 76A. A plate-form regulation member 79 is provided along the length direction of the aperture portion 76A at a region in the case member 76 that is close to the aperture portion 76A. The regulation member 79 is for regulating a developer layer thickness.

The developing roller 74 is structured with a cylindrical developing sleeve 74A that is rotatably provided and a magnetic member 74B that is formed of plural magnets fixed at the inner side of the developing sleeve 74A. A magnetic brush of the developer (the carrier) is formed by the developing sleeve 74A rotating, and a developer layer is formed at the outer peripheral face of the developing sleeve 74A by the thickness of the layer being regulated by the regulation member 79. The developer layer at the outer peripheral face of the developing sleeve 74A is conveyed to a position opposing the photoreceptor 62 and development is implemented by the toner being adhered to the outer peripheral face of the photoreceptor 62 in accordance with the latent image that has been formed (the electrostatic latent image).

Two conveyance rollers 77 formed in helical shapes are disposed to be parallel with one another in the case member 76. By the two conveyance rollers 77 rotating, the developer charged into the case member 76 is circulatingly conveyed in the axial direction of the developing roller 74 (the length direction of the developing unit 72Y). The six developing rollers 74 provided at the developing units 72Y, 72M, 72C, 72K, 72E and 72F are disposed along the circumferential direction such that the spacing between the developing rollers 74 is 60° about the center. When the developing units 72 are switched between, the next developing roller 74 opposes the outer peripheral face of the photoreceptor 62.

Next, the cleaning device 100 is described.

Figure 3:
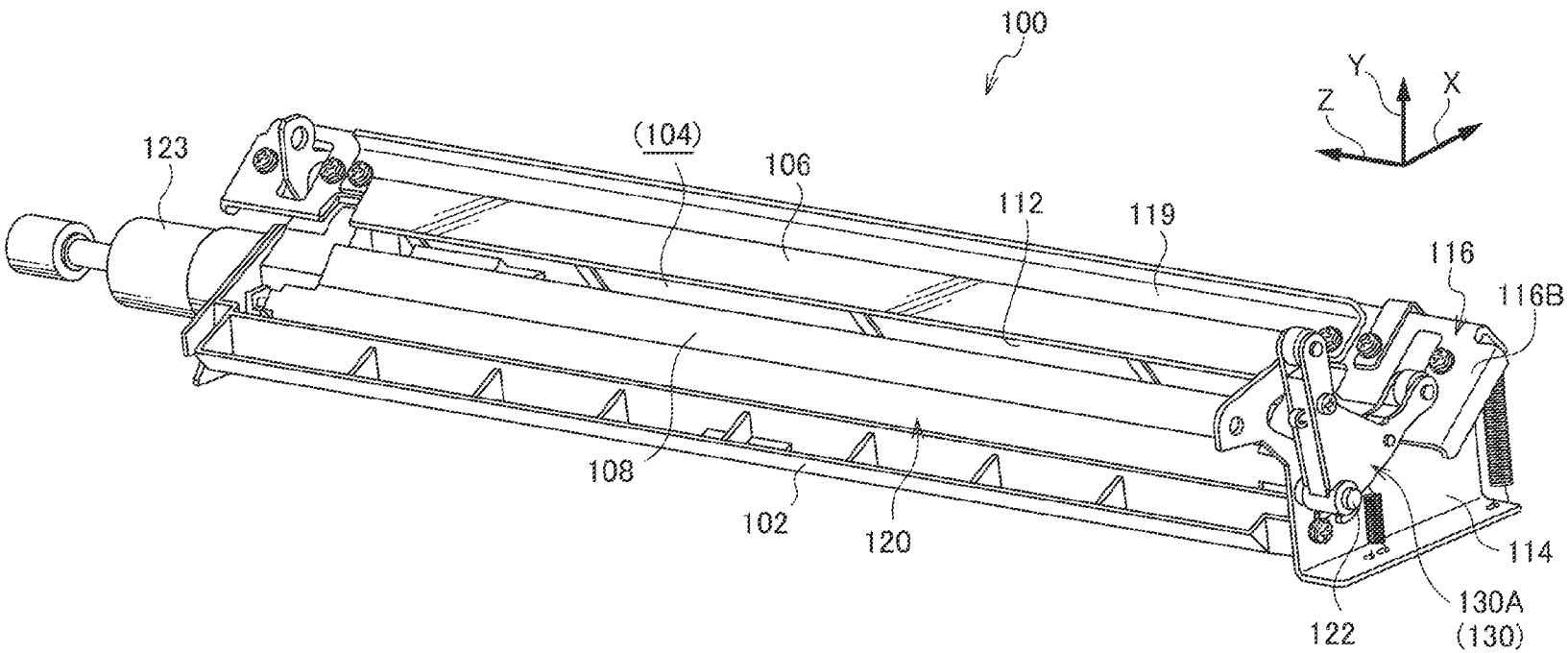
FIG. 3 is a perspective diagram of a cleaning device relating to the exemplary embodiment of the present invention.

As illustrated in FIG. 3, the cleaning device 100 includes a casing 102, a cleaning blade 106 that serves as an example of a recovery member, and a seal member 108 that serves as an example of a sealing member. A rectangular aperture portion 104 is formed in the casing 102. The aperture portion 104 is disposed to oppose the intermediate transfer belt 68 (see FIG. 2). The cleaning blade 106 is disposed at the aperture portion 104, touches against the intermediate transfer belt 68 and recovers toner. The seal member 108 is disposed at the aperture portion 104 at a position at the opposite side thereof from the cleaning blade 106, touches against the intermediate transfer belt 68, and seals a gap between the casing 102 and the intermediate transfer belt 68.

The cleaning device 100 further includes a suction unit 110 that serves as an example of the suction section (see FIG. 7, FIG. 8 and FIG. 9), a filter 112, and a portion of a retraction mechanism section 130 that serves as an example of a moving section. The suction unit 110 sucks remaining toner and the like on the intermediate transfer belt 68 into the casing 102. The filter 112 is disposed inside the casing 102 and collects dust including the toner. The retraction mechanism section 130 moves the cleaning blade 106 and the seal member 108 between a position of being touched against the outer peripheral face of the intermediate transfer belt 68 and a position of being moved apart from the outer peripheral face of the intermediate transfer belt 68.

Herebelow, arrangements of the respective members in the casing 102 are described with the length direction of the casing 102 and the aperture portion 104 being represented by the direction of arrow Z, an inner face direction of a floor wall 102A (see FIG. 4B) of the casing 102 that is orthogonal to the direction of arrow Z being represented by the direction of arrow X, and a height direction of the casing 102 that is orthogonal to the direction of arrow X and the direction of arrow Z being represented by the direction arrow Y. The direction of arrow Z is a direction from the near side to the far side of the image forming device 10 in the front view (see FIG. 1).

Figure 4A:
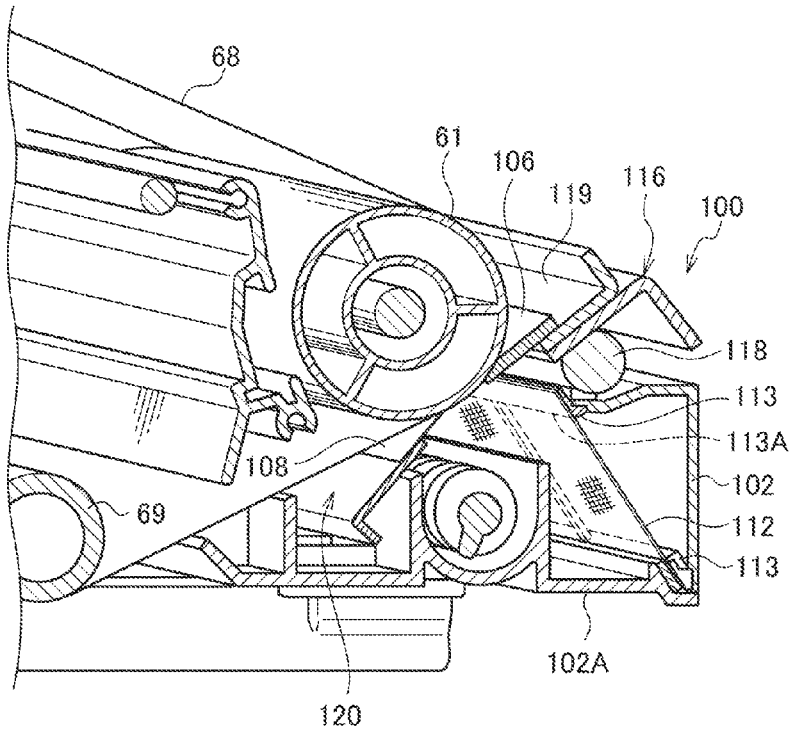
FIG. 4A is a perspective diagram illustrating internal structure of the cleaning device relating to the exemplary embodiment of the present invention (when touching an intermediate transfer belt)
Figure 4B:
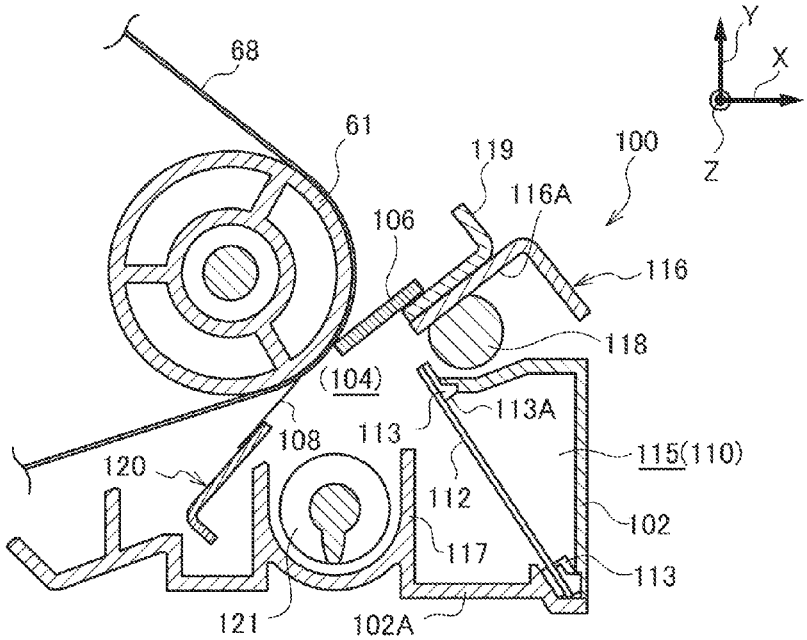
FIG. 4B is a sectional diagram illustrating the internal structure of the cleaning device relating to the exemplary embodiment of the present invention (when touching an intermediate transfer belt)

As illustrated in FIG. 3, FIG. 4A and FIG. 4B, the casing 102 is a member with a form in which both end portions in the direction of arrow Z, and a left end portion of a top wall and an upper end portion of a left side wall as seen in the direction of arrow Z are open. Side plates 114 are attached to the two end portions in the direction of arrow Z of the casing 102 with screws. A first movable member 116 is disposed at an upper portion of the casing 102. The first movable member 116 is formed of a metal plate that has length in the direction of arrow Z and an L shape in the X-Y plane. In FIG. 4A and FIG. 4B, a state in which the cleaning blade 106 and the seal member 108 touch the intermediate transfer belt 68 is illustrated.

The first movable member 116 is disposed with an upward projecting shape in the X-Y plane. A support axle 118 whose axial direction is in the direction of arrow Z is fixed to a rear side of an inclined portion 116A (the portion that is inclined downward to the left in the drawings). The two end portions of the support axle 118 are rotatably supported by bearings (not illustrated) provided at the side plates 114. A support plate 119 is attached by screws to an upper face of the inclined portion 116A of the first movable member 116. The support plate 119 is formed of a metal plate with an L shape in the X-Y plane. One short direction end portion of the cleaning blade 106, which is disposed along the direction of inclination of the inclined portion 116A, is fixed by adhesion to a lower portion of the support plate 119.

The cleaning blade 106 is a plate member made of resin that is rectangular in plan view. The cleaning blade 106 is attached to the support plate 119 such that the length direction of the cleaning blade 106 runs along the length direction of the aperture portion 104. Thus, the cleaning blade 106 is disposed along an edge portion of the aperture portion 104 at the downstream side of the conveyance direction of the intermediate transfer belt 68 (the direction of arrow −R). When the below-described retraction mechanism section 130 is disposed in the touching state, the cleaning blade 106 is disposed such that the free end side thereof (the other end portion that is not adhered to the support plate 119) touches against the intermediate transfer belt 68. The cleaning blade 106 recovers remaining toner on the intermediate transfer belt 68 into the casing 102. A second movable member 120 is disposed at the left side of the casing 102 in the X-Y plane. The second movable member 120 is formed of a metal plate in an L shape, whose length direction is in the direction of arrow Z.

The second movable member 120 is disposed so as to project toward the left side in the X-Y plane. A support axle (not illustrated) whose axial direction is in the direction of arrow Z is fixed to a rear side of an inclined portion 120A (the inclined portion that descends downward to the left in the drawing). Thus, the second movable member 120 is rotatably supported. The second movable member 120 is configured to rotate (move) in conjunction with the first movable member 116. One short direction end portion of the seal member 108 is fixed by adhesion to an upper portion of the inclined portion 120A of the second movable member 120.

The seal member 108 is, for example, a transparent film material that is rectangular in plan view. The seal member 108 is attached to the second movable member 120 so as to touch against the intermediate transfer belt 68 along an edge portion of the aperture portion 104 at the upstream side of the conveyance direction of the intermediate transfer belt 68. When the below-described retraction mechanism section 130 is disposed in the touching state and the cleaning blade 106 touches against the intermediate transfer belt 68, the seal member 108 is disposed such that the free end thereof (the other end portion that is not adhered to the second movable member 120) touches against the intermediate transfer belt 68. Thus, a gap between the second movable member 120 and the intermediate transfer belt 68 is sealed. The seal member 108 is disposed at the lower side relative to the intermediate transfer belt 68. The distal end portion of the seal member 108 is disposed along the direction of movement of the intermediate transfer belt 68, and toner T is not scraped off by the seal member 108.

The first movable member 116, the support axle 118, the support plate 119 and the second movable member 120 are members that constitute portions of the casing 102, and the aperture portion 104 is a region of the casing 102 that is opened from the lower end portion of the support plate 119 to the upper end portion of the second movable member 120.

As illustrated in FIG. 4A and FIG. 4B, an attachment member 113 is disposed at the right side of the casing 102 in the X-Y plane. The attachment member 113 is for attaching the filter 112, which is described in more detail below, inside the casing 102. The attachment member 113 has the form of a frame in which aperture portions 113A are formed in a plate member that is rectangular in plan view. The aperture portions 113A are constituted by a plural number of square through-holes along the length direction of the plate member. The attachment member 113 is disposed at an angle inside the casing 102 such that a lower portion thereof is further away from the intermediate transfer belt 68 and the aperture portion 104 than an upper portion thereof. A suction channel 115, with the form of an inverted triangle in the X-Y plane, is formed at the right side of the casing 102 that is partitioned by the attachment member 113. The suction channel 115 structures a portion of the suction unit 110, which is described in more detail below. The filter 112 is attached inside the casing 102 by the attachment member 113.

The filter 112 is an aggregation of fibers, and forms a long rectangular shape along the length direction of the casing 102 (the direction of arrow Z) in a front view. The filter 112 is adhered to the attachment member 113, and is disposed in the casing 102 between the aperture portion 104 and the suction channel 115 at an angle such that a lower portion thereof is further from the aperture portion 104 than an upper portion thereof. A dividing wall 117 is also provided in the casing 102. The dividing wall 117 stands from the floor wall 102A between the aperture portion 104 and the filter 112 in a side view of the casing 102 (the X-Y plane).

Figure 10A:
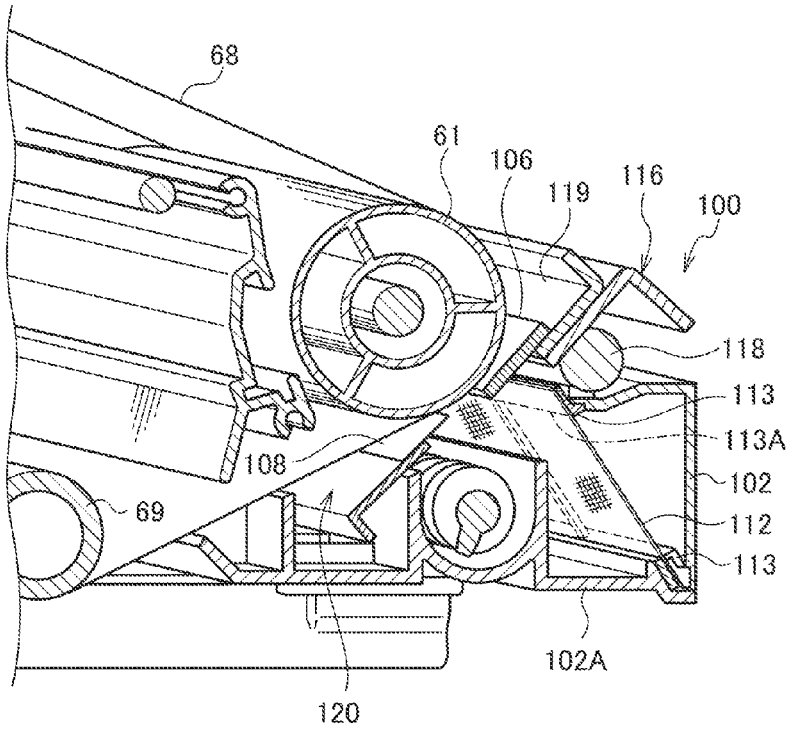
FIG. 10A is a perspective diagram illustrating the internal structure of the cleaning device relating to the exemplary embodiment of the present invention.
Figure 10B:
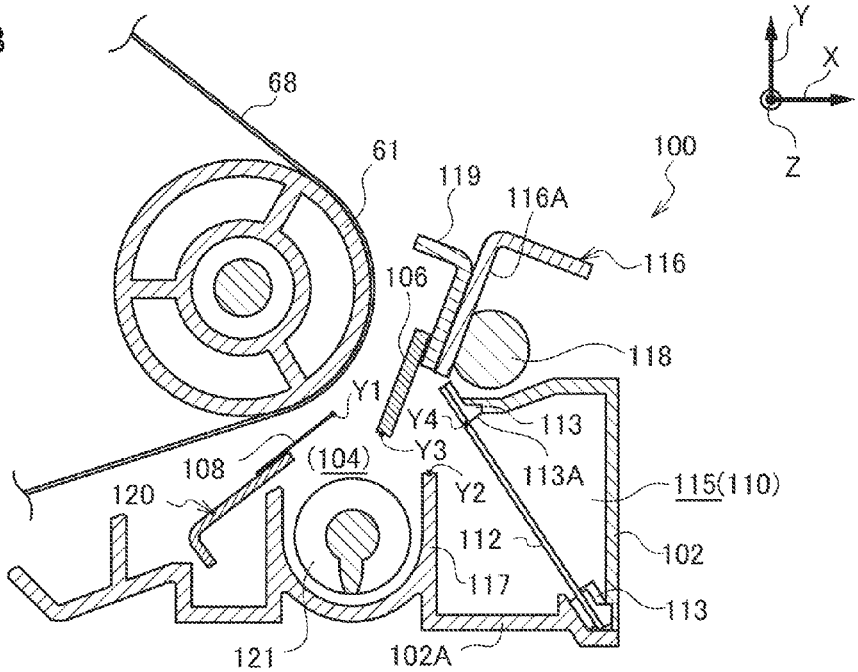
FIG. 10B is a sectional diagram illustrating the internal structure of the cleaning device relating to the exemplary embodiment of the present invention (when moved apart from the intermediate transfer belt)

In FIG. 10A and FIG. 10B, a state is illustrated in which the cleaning blade 106 and the seal member 108 are moved apart from the intermediate transfer belt 68. Hereinafter, the state in which the cleaning blade 106 and the seal member 108 are moved apart from the intermediate transfer belt 68 is referred to as the retracted state. A height of the dividing wall 117 is set such that, in this retracted state, an upper end position Y1 of the seal member 108 is disposed at the upper side relative to an upper end position Y2 of the dividing wall 117. The attachment position of the filter 112 is set such that, in the retracted state, an upper end position Y4 of the filter 112 is disposed at the upper side relative to a lower end position Y3 of the cleaning blade 106.

As illustrated in FIG. 4A and FIG. 4B, a conveyance member 121 is disposed in the lower portion of the casing 102, between the dividing wall 117 and the second movable member 120. A plural number of helical channels are formed at an outer peripheral face of the conveyance member 121, and the conveyance member 121 is rotatably provided with the rotation axis direction thereof in the direction of arrow Z. The conveyance member 121 is provided with a driving section (not illustrated) including a motor at the far side of the direction of arrow Z. The conveyance member 121 is driven by control by the control section 20 (see FIG. 1). Thus, the conveyance member 121 conveys the toner recovered into the casing 102 to the far side in the direction of arrow Z. As illustrated in FIG. 3, a cylindrical recovery channel 123 is provided at the far side of the casing 102 in the direction of arrow Z. The toner conveyed by the conveyance member 121 flows through the recovery channel 123 to a recovery tank (not illustrated).

As illustrated in FIG. 6, FIG. 7, FIG. 8 and FIG. 9, the suction unit 110 is structured to include the suction channel 115 in the casing 102, a first duct 126, a second duct 144, a third duct 146 and a fan unit for air intake 148. The first duct 126 is connected to one end in the direction of arrow Z of the suction channel 115 (at the far side of the image forming device 10 (see FIG. 1)). The second duct 144 is connected to an other end of the first duct 126 (an aperture portion 128, which is described below). The third duct 146 is connected to a lower end of the second duct 144. The fan unit for air intake 148 is attached to the third duct 146.

Figure 6:
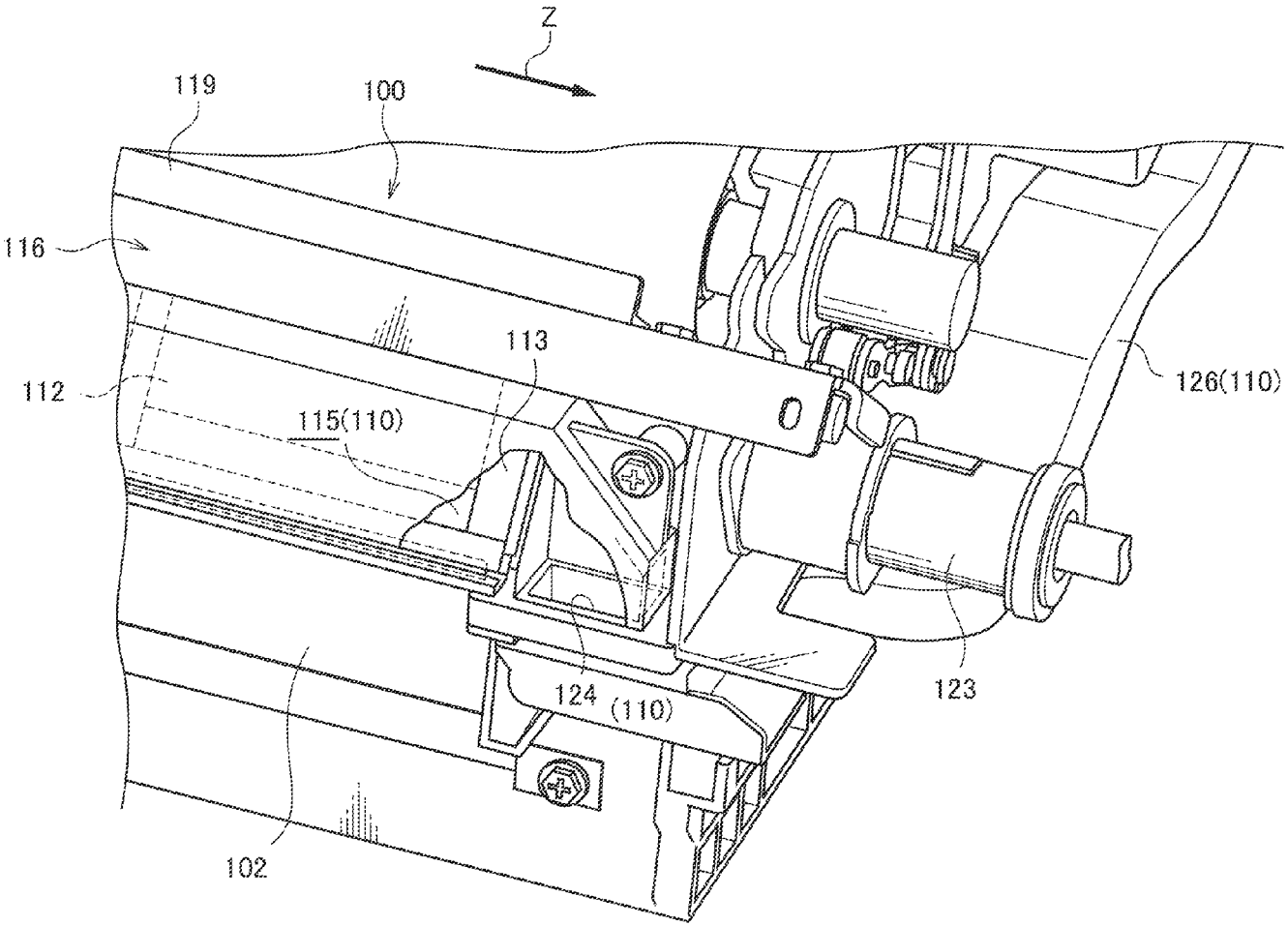
FIG. 6 is a perspective diagram illustrating a suction device of the cleaning device relating to the exemplary embodiment of the present invention.

As illustrated in FIG. 6, a rectangular aperture portion 124 is formed at a bottom portion at the one end in the direction of arrow Z of the suction channel 115, and a one end portion of the first duct 126 is connected to the aperture portion 124 at this bottom portion. Thus, because the aperture portion 124 is disposed at the bottom portion of the suction channel 115, suction is implemented in the suction channel 115 at the lower side relative to the upper end of the dividing wall 117 (see FIG. 4B).

Figure 7:
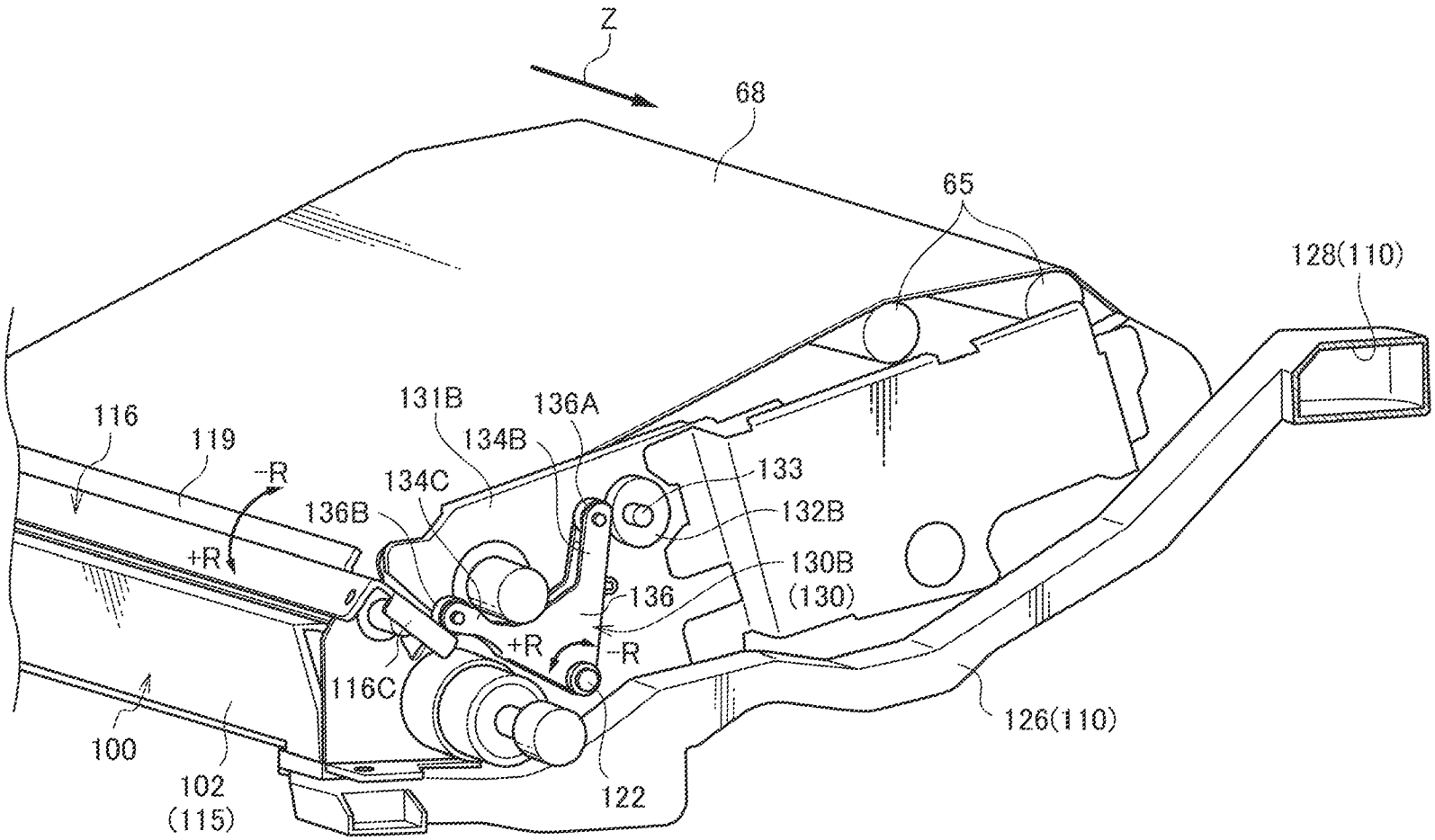
FIG. 7 is a perspective diagram illustrating a state of arrangement of a suction duct relating to the exemplary embodiment of the present invention.

As illustrated in FIG. 7, the first duct 126 is formed in a tube shape, and is disposed at the far side of the image forming device 10 (the far side of the front view in FIG. 1) and at the far side of the intermediate transfer belt 68. The aperture portion 128 that is connected to the second duct 144 is disposed at an other end portion of the first duct 126.

Figure 8:
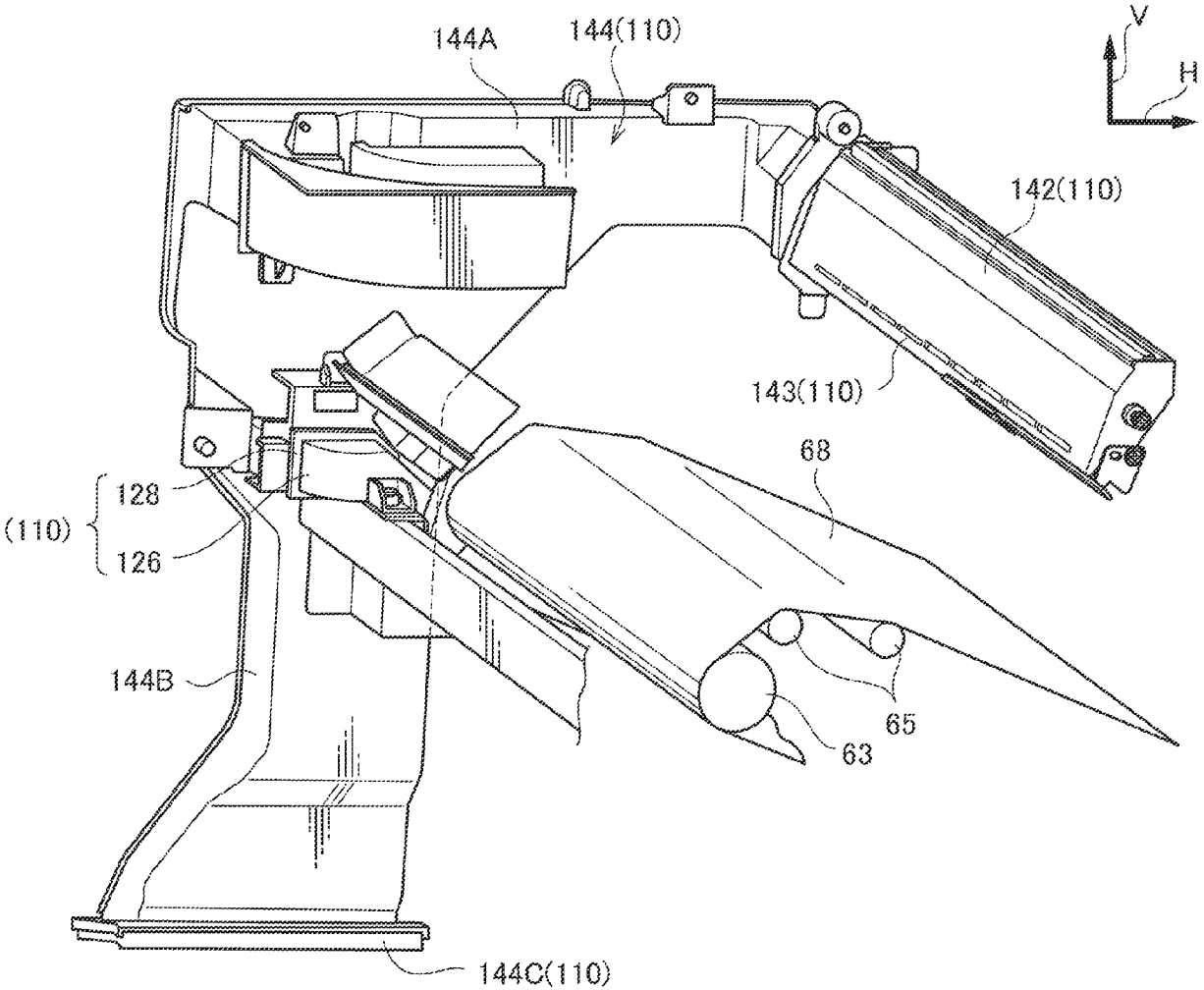
FIG. 8 is a perspective diagram illustrating another suction duct that is provided at a different position from the cleaning device of the image forming device relating to the exemplary embodiment of the present invention.

As illustrated in FIG. 8, the second duct 144 is formed in a tube shape and is formed as a whole in an L shape in front view. The second duct 144 includes a horizontal portion 144A, which has length in the direction of arrow H in front view, and a vertical portion 144B, which has length to the lower side in the direction of arrow V from a left end portion of the horizontal portion 144A. An aperture portion 144C, which is connected to the third duct 146 (see FIG. 9), is provided at the lower end of the vertical portion 144B. A fourth duct 142 is connected to a right end portion of the horizontal portion 144A in front view. The fourth duct 142 is above the intermediate transfer belt 68 and a length direction of the fourth duct 142 is the width direction of the intermediate transfer belt 68.

The fourth duct 142 is formed in a cuboid shape. A plural number of aperture portions 143 are formed in the fourth duct 142 along the length direction at a lower portion of one side wall to the direction of arrow H. The fourth duct 142 is disposed at a position near the charging member 64 (see FIG.

2). The fourth duct 142 intakes ozone and the like produced by the charging of the photoreceptor 62 by the charging member 64.

Figure 9:
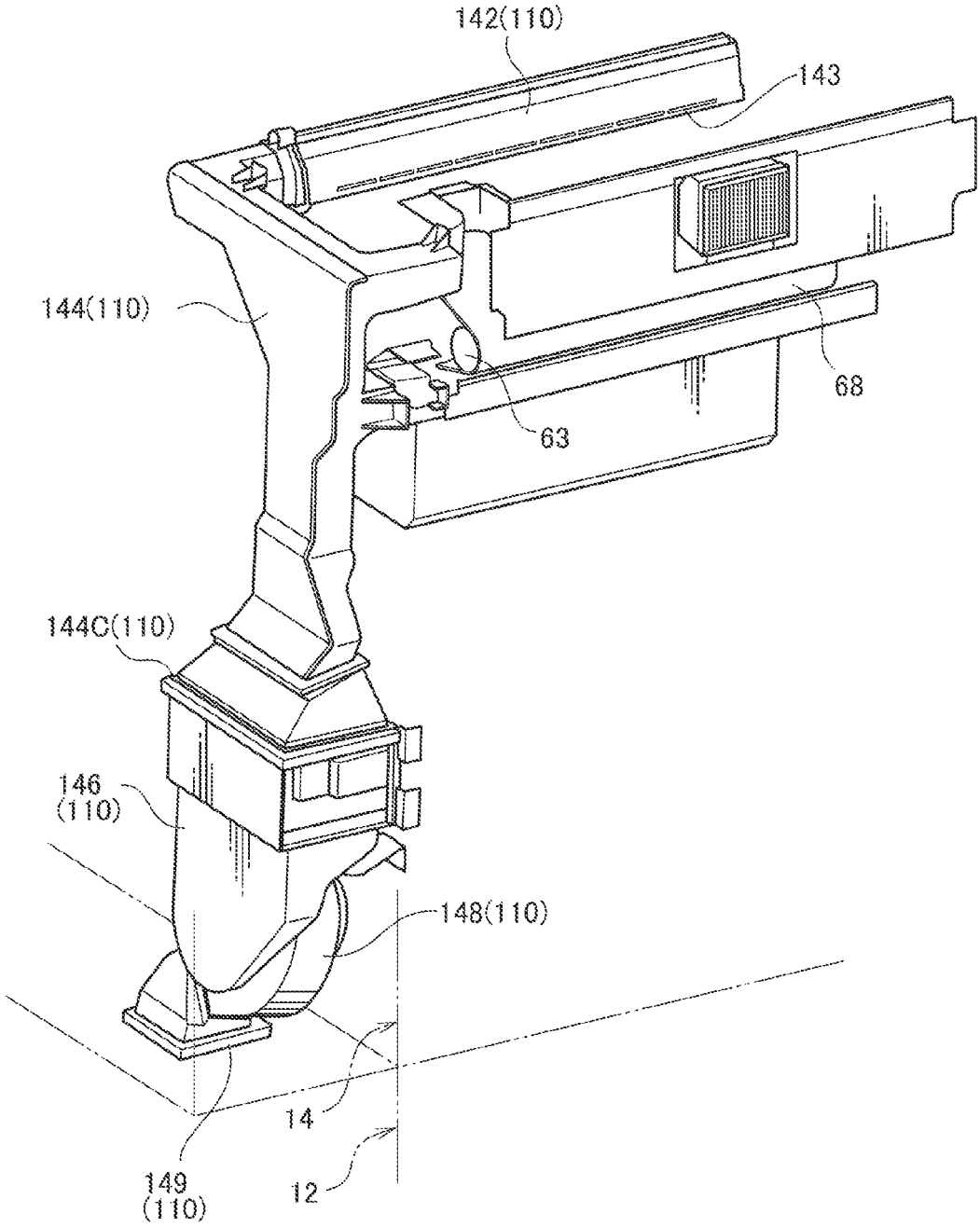
FIG. 9 is a perspective diagram illustrating an outflow section that is provided at an upstream side of the suction ducts relating to the exemplary embodiment of the present invention.

As illustrated in FIG. 9, the third duct 146 is attached to the lower side of the second duct 144. An outflow aperture 149 is provided at a lower end of the third duct 146. The outflow aperture 149 exhausts air by rotation of a fan (not illustrated) provided in the fan unit 148. The fan unit 148 is operated to turn the fan thereinside, and operated to stop the fan, by the control section 20 (see FIG. 1). The outflow aperture 149 is disposed at the front view far side of the image forming device 10 (see FIG. 1), at the bottom face of a side of the image forming section 14 at which a step between the image forming section 14 and the paper accommodation section 12 is formed. Thus, the suction unit 110 is configured such that interiors of the suction channel 115, the first duct 126, the second duct 144, the third duct 146 and the fourth duct 142 are linked and such that air that is sucked through the various portions by negative pressure generated by operation of the air intake 148 is exhausted through the outflow aperture 149 to outside the image forming device 10.

Figure 5:
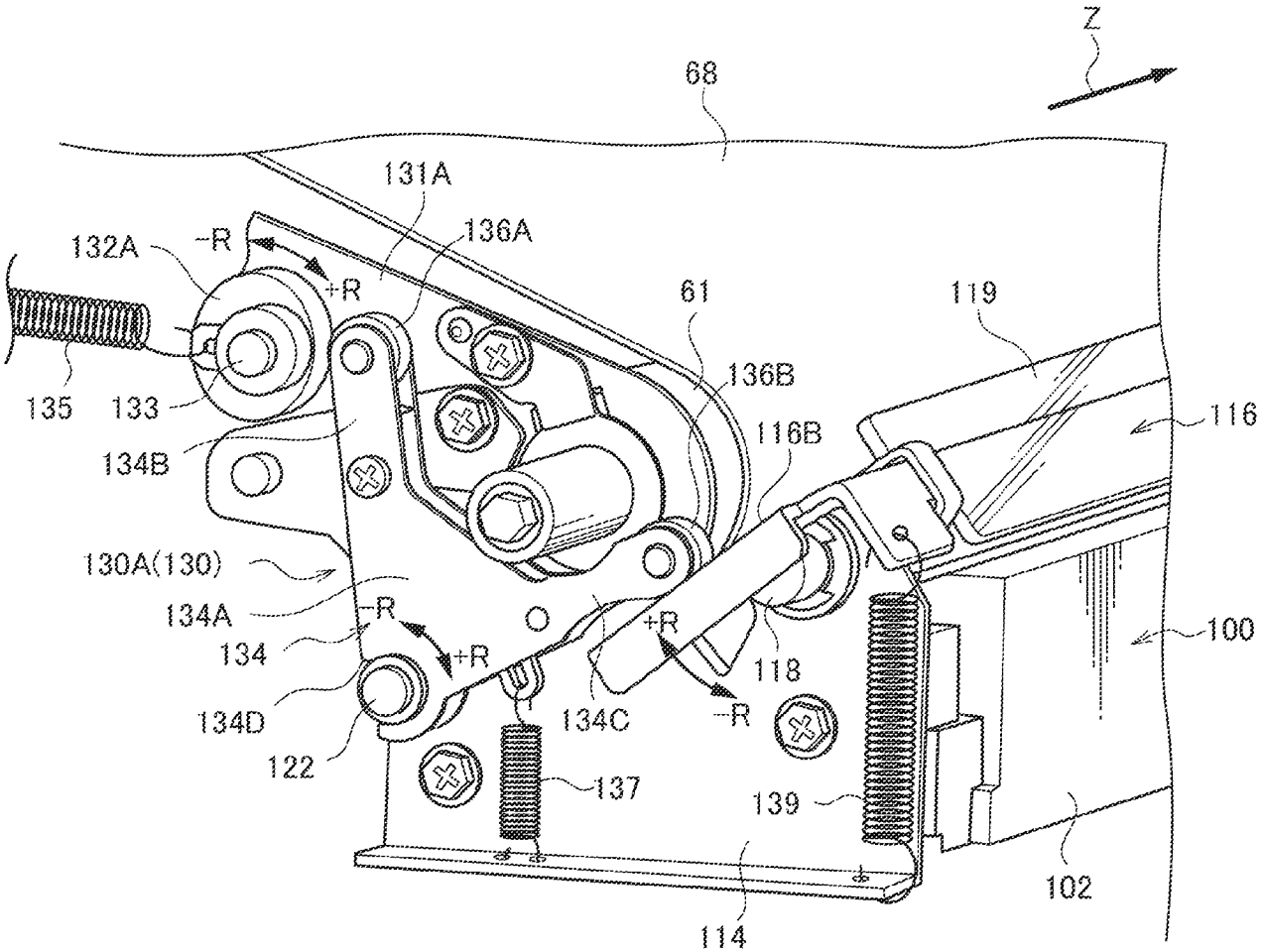
FIG. 5 is a perspective diagram illustrating a retraction mechanism section of the cleaning device relating to the exemplary embodiment of the present invention.

As illustrated in FIG. 5 and FIG. 7, the retraction mechanism section 130 is structured with a first mechanism section 130A that is disposed at the near side of the direction of arrow Z and a second mechanism section 130B that is disposed at the far side. A side plate 131A is disposed at the near side and a side plate 131B is disposed at the far side, respectively at positions close to the two ends in the direction of arrow Z (the width direction) of the intermediate transfer belt 68.

As illustrated in FIG. 5, the first mechanism section 130A is structured to include an eccentric cam 132A and a link member 134. The eccentric cam 132A is turned by a power source (not illustrated). The link member 134 is disposed at the side plate 114 of the cleaning device 100, is moved by turning of the eccentric cam 132A, and causes the first movable member 116 and the second movable member 120 (see FIG. 3) to move.

The eccentric cam 132A is attached to one end of a shaft member 133 (at the near end side of the direction of arrow Z), which is rotatably disposed at the side plate 131A and the side plate 131B (see FIG. 7). One end of a spring 135 is attached to the side plate 131A. The other end of the spring 135 is attached to a portion of the eccentric cam 132A that is eccentric about the shaft member 133.

The link member 134 has a structure with a shape close to a V shape in front view in which two plate members of the same size are made integral with a space therebetween. More specifically, the link member 134 includes a main body portion 134A, a first arm 134B, and a second arm 134C. The main body portion 134A has the shape of an inverted triangle. The first arm 134B extends diagonally upward to the left from an upper left portion of the main body portion 134A in front view. The second arm 134C extends diagonally upward to the right from an upper right portion of the main body portion 134A in front view. A circular arc-shaped notch portion 134D is formed in the lower end (a peak angle portion) of the main body portion 134A. A support axle 122 is fixed in the notch portion 134D. Rollers 136A and 136B are rotatably provided at upper end portions of the first arm 134B and the second arm 134C, respectively. The two axial direction end portions of the support axle 122 are rotatably supported by bearings (not illustrated) that are provided at the side plate 114 and the side plate 131B (see FIG. 6).

The link member 134 is movable in the +R direction (the clockwise direction in the drawing) and the −R direction (the counter-clockwise direction in the drawing) with the support axle 122 serving as a fulcrum. Thus, the first arm 134B and the second arm 134C move in the +R direction and the −R direction.

One end of a spring 137 is attached to the main body portion 134A at the second arm 134C side of the link member 134, and the other end of the spring 137 is attached to a bottom portion of the side plate 114. Thus, in a state in which the eccentric cam 132A is not touching thereagainst, a force that causes the link member 134 to turn in the +R direction acts on the link member 134. One end of a spring 139 is attached to an end portion of the first movable member 116, and the other end of the spring 139 is attached to the bottom portion of the side plate 114. Thus, a force that causes the first movable member 116 to turn in the +R direction acts on the first movable member 116. The roller 136B touches against a contact portion 116B, which is a flat surface disposed at a near side end portion of the first movable member 116.

The roller 136A touches against the eccentric cam 132A with turning of the eccentric cam 132A in the +R direction, or separates from the eccentric cam 132A with turning of the eccentric cam 132A in the −R direction. When the eccentric cam 132A touches against the roller 136A and causes the link member 134 to move in the +R direction, the roller 136B pushes against the contact portion 116B of the first movable member 116 and causes the first movable member 116 to move in the −R direction. Further, when the eccentric cam 132A moves away from the roller 136A, the first movable member 116 moves in the +R direction.

As illustrated in FIG. 7, the second mechanism section 130B is structured to include an eccentric cam 132B and a link member 136. The eccentric cam 132B is turned by a power source (not illustrated) provided at the side plate 131B. The link member 136 is similarly disposed at the side plate 131B, is moved by turning of the eccentric cam 132B, and causes the first movable member 116 and the second movable member 120 (see FIG. 3) to move. The eccentric cam 132B is attached to one end of the shaft member 133 (the far end in the direction of arrow Z).

The link member 136 has a similar structure to the link member 134 (see FIG. 5). The link member 136 moves in the +R direction or the −R direction with the aforementioned support axle 122, whose other end is exposed from the side plate 131B, serving as a fulcrum. Thus, the first arm 134B and the second arm 134C move in the +R direction and the −R direction. Similarly to the link member 134, a force that causes the link member 136 to turn in the +R direction acts on the link member 136 in the state in which the eccentric cam 132B does not touch thereagainst. Further, a force that the first movable member 116 to turn in the +R direction acts on the first movable member 116 in the state in which the link member 136 does not touch thereagainst. The roller 136B touches against a contact portion 116C, which is a flat surface provided at a far side end portion of the first movable member 116.

The roller 136A touches against the eccentric cam 132B with turning of the eccentric cam 132B in the +R direction, or is separated from the eccentric cam 132B with turning of the eccentric cam 132B in the −R direction. When the eccentric cam 132B touches against the roller 136A and causes the link member 136 to move in the +R direction, the roller 136B pushes against the contact portion 116C of the first movable member 116 and causes the first movable member 116 to move in the −R direction. Further, when the eccentric cam 132B moves away from the roller 136A, the first movable member 116 moves in the +R direction.

Next, operation of the present exemplary embodiment is described.

First, an image forming process of the image forming device 10 is described.

As illustrated in FIG. 1, when the image forming device 10 operates, image data of the colors yellow (Y), magenta (M), cyan (C), black (K), the first spot color (E) and the second spot color (F) is sequentially outputted to the exposure device 66 from an image processing device (not illustrated) or from outside the image forming device 10. At this time, for example, the developing device 70 turns and holds such that the developing unit 72Y (see FIG. 2) opposes the outer peripheral face of the photoreceptor 62. As illustrated in FIG. 10B, the cleaning blade 106 and seal member 108 of the cleaning device 100 are moved apart from the outer peripheral face of the intermediate transfer belt 68 by operation of the retraction mechanism section 130 (see FIG. 3) until the toner images of the respective colors are superposedly transferred (primary transferred) onto the intermediate transfer belt 68 and secondary transferred onto the recording paper P.

Then, light emitted from the exposure device 66 in accordance with the image data exposes the outer peripheral face (surface) of the photoreceptor 62 that has been charged up by the charging member 64, and an electrostatic latent image corresponding to the yellow image data is formed on the surface of the photoreceptor 62. The electrostatic latent image formed on the surface of the photoreceptor 62 is developed as a yellow toner image by the developing unit 72Y. The yellow toner image on the surface of the photoreceptor 62 is transferred to the intermediate transfer belt 68 by the primary transfer roller 67.

Then, as illustrated in FIG. 1, the developing device 70 turns 60° in the direction of arrow +R, and the developing unit 72M opposes the surface of the photoreceptor 62. The steps of charging, exposure and development are carried out, and a magenta toner image on the surface of the photoreceptor 62 is transferred onto the yellow toner image on the intermediate transfer belt 68 by the primary transfer roller 67. Similarly, toner images of cyan (C) and black (K), and also the first spot color (E) and second spot color (F) depending on color settings, are sequentially superposedly transferred onto the intermediate transfer belt 68.

Meanwhile, a recording paper P that is fed out from the paper accommodation section 12 and conveyed along the conveyance path 28 is conveyed to the secondary transfer position with a timing that is matched by the positioning roller 38 with the superposed transfer of the toner images onto the intermediate transfer belt 68. The toner images that have been superposedly transferred onto the intermediate transfer belt 68 are secondary transferred onto the recording paper P that has been conveyed to the secondary transfer position by the secondary transfer roller 71. After the secondary transfer, as illustrated in FIG. 4B, the cleaning blade 106 and seal member 108 of the cleaning device 100 are touched against the outer peripheral face of the intermediate transfer belt 68 by operation of the retraction mechanism section 130 (see FIG. 3). Hence, toner T that is adhered to the outer peripheral face of the intermediate transfer belt 68 is separated by the cleaning blade 106 and recovered into the casing 102.

Then, the recording paper P onto which the toner images have been transferred is conveyed in the direction of arrow A toward the fixing device 80 (rightward in the drawing). At the fixing device 80, the toner image is heated and pressed by the heating roller 82 and the pressure roller 84 and thus fixed to the recording paper P. The recording paper P to which the toner images have been fixed is, for example, ejected to the ejection section 15. However, if images are to be formed on both faces of the recording paper P, then after the fixing of the image to the surface by the fixing device 80, the recording paper P is fed along the direction of arrow −V into the inversion portion 33, and fed out along the direction of arrow +V, and thus the leading end and trailing end of the recording paper P are swapped. Then, the recording paper P is conveyed in the direction of arrow B (leftward in the drawing) by the two-sided printing conveyance path 29, is fed into the conveyance path 28, and image formation and fixing are applied to the rear face of the recording paper P (at this time, the cleaning blade 106 and seal member 108 are in the retracted state). After this fixing, the cleaning blade 106 and the seal member 108 are touched against the outer peripheral face of the intermediate transfer belt 68 by operation of the retraction mechanism section 130, and toner T adhered to the outer peripheral face of the intermediate transfer belt 68 is separated by the cleaning blade 106 and recovered into the casing 102.

Next, operation of the cleaning device 100 and the suction unit 110 is described.

Figure 11A:
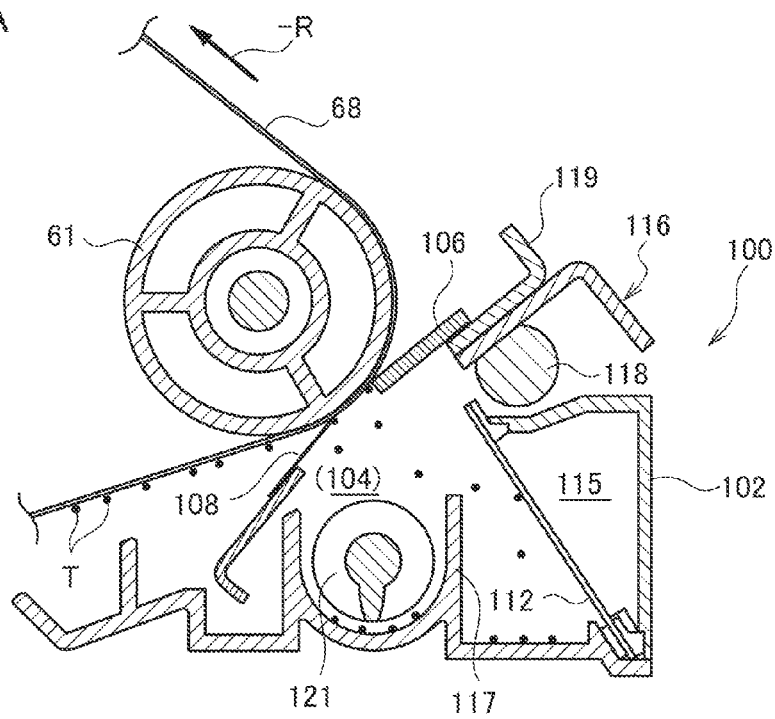
FIG. 11A is a sectional diagram illustrating a condition of recovery of toner in a state in which a cleaning blade and sealing member relating to the exemplary embodiment of the present invention are touching against the intermediate transfer belt.

In the state in which the eccentric cam 132A and the eccentric cam 132B of FIG. 5 and FIG. 7 are not turned and the link members 134 and 136 are not pushed by the eccentric cams 132A and 132B, as illustrated in FIG. 11A, the distal end of the cleaning blade 106 and the distal end of the seal member 108 touch against the outer peripheral face of the intermediate transfer belt 68. The state in which the eccentric cams 132A and 132B in FIG. 5 and FIG. 7 are turned and the eccentric portions push the link members 134 and 136, as illustrated in FIG. 11B, is the retracted state in which the distal end of the cleaning blade 106 and the distal end of the seal member 108 are moved apart from the outer peripheral face of the intermediate transfer belt 68.

As illustrated in FIG. 11A, when the toner images on the intermediate transfer belt 68 are secondary transferred onto the recording paper P (not illustrated), transfer residue toner T adheres to the outer peripheral face of the intermediate transfer belt 68. When the intermediate transfer belt 68 moves to turn in the −R direction, the transfer residue toner T is conveyed to the cleaning device 100, and is recovered into the casing 102 by the cleaning blade 106. At this time, the seal member 108 is touching against the outer peripheral face of the intermediate transfer belt 68. Thus, the gap between the casing 102 and the intermediate transfer belt 68 is sealed. Therefore, the toner T that is recovered into the casing 102 is prevented from leaking to the outside of the casing 102. The distal end portion of the seal member 108 is disposed along the movement direction of the intermediate transfer belt 68. Thus, the toner T is not scraped off by the seal member 108.

Figure 11B:
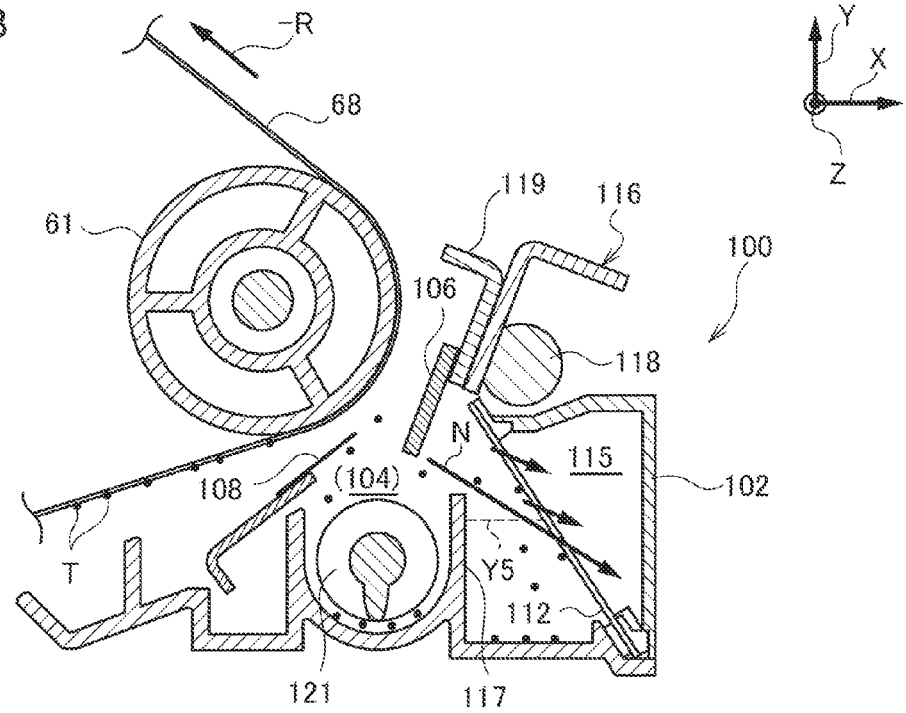
FIG. 11B is a sectional diagram illustrating a condition of recovery of toner in a state in which the cleaning blade and seal member relating to the exemplary embodiment of the present invention are moved apart from the intermediate transfer belt.

Then, when a next image formation by the image forming device 10 (see FIG. 1) is to start, as illustrated in FIG. 11B, the cleaning blade 106 and seal member 108 go to the retracted state in which they are moved apart from the outer peripheral face of the intermediate transfer belt 68. The fan unit 148 of the suction unit 110 (see FIG. 9) is driven continuously. Therefore, the suction channel 115 and the inside of the casing 102 are in a negative pressure state at this time, and air is taken in from the casing 102 to the suction channel 115. Thus, a flow of air in the direction of the arrows N from the aperture portion 104 to the filter 112 (a direction inclined toward the lower right side of the X-Y plane) is formed.

Here, because the filter 112 is made long in the length direction of the casing 102 and disposed to be inclined within the casing 102, an area of disposition of the filter 112 is larger than if the filter 112 stood vertically within the casing 102. Therefore, the filter 112 is unlikely to be clogged with toner T from an initial period of usage of the image forming device 10 (see FIG. 1).

Furthermore, the filter 112 is disposed at an incline, the upper end of the seal member 108 is at the upper side relative to the upper end of the dividing wall 117, and air intake by the suction unit 110 is implemented through the aperture portion 124 that is at the bottom of the suction channel 115 (see FIG. 6). Therefore, the air that is taken in flows in the direction of the arrows N from the aperture portion 104 toward the filter 112 (in a direction diagonally downward). That is, the air that flows into the casing 102 is oriented downward toward the lower portion rather than the upper portion of the filter 112, and an amount of air flowing to the lower portion of the filter 112 is increased. Thus, the toner T that is recovered into the casing 102 is oriented toward the lower portion of the filter 112, and is trapped by the filter 112 or drops between the filter 112 and the dividing wall 117 and is stored.

Because the toner T is stored from the lower portion of the casing 102, the upper portion of the filter 112 does not become clogged with toner T from an initial period of use of the image forming device 10 (see FIG. 1). Given these operations, even when the cleaning blade 106 and the seal member 108 are moved apart from the outer peripheral face of the intermediate transfer belt 68, a reduction in suction force of the toner by the suction unit 110 is suppressed, and scattering of the toner from the cleaning device 100 to the intermediate transfer belt 68 is restrained.

In the cleaning device 100, the upper end of the filter 112 is disposed at the upper side relative to the lower end of the cleaning blade 106 and, in the retracted state, the distal end portion of the cleaning blade 106 is moved downward. Therefore, even if the toner T that drops from the filter 112 is accumulated up to, for example, a height Y5 of an upper portion of the dividing wall 117, there is a space between the cleaning blade 106 and the filter 112. Therefore, continuous suction is implemented at the upper portion of the filter 112, and the cleaning device 100 may be used for long periods.

Note that the present invention is not to be limited by the exemplary embodiments described above.

The developing device 70 is not necessarily provided with developing units for six colors, and may be provided with, for example, developing units for four colors spaced at 90°, or may be provided with plural developing units of two or more colors other than four colors and six colors. Further, the charging member 64 may be a contact-type charging roller. Further, the cleaning device 100 is not limited to a device in which the casing 102 is fixed inside the image forming device 10; the whole of the casing 102 may be brought closer to the intermediate transfer belt 68 or moved further away, and the cleaning blade 106 and seal member 108 touched against the outer peripheral face of the intermediate transfer belt 68 and moved apart from the outer peripheral face. Further, cleaning of the outer peripheral face of the photoreceptor 62 may be performed with the cleaning device 100.

The present invention is not limited to the above exemplary embodiment only but can be varied, modified or improved in various other ways.

The foregoing description of the embodiments of the present invention has been provided for the purpose of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to are suited to the particular use contemplated. It is intended that the scope of the invention be defined by the following claims and their equivalents.

What is claimed is:

1. A developer recovery device comprising:

a casing at which an aperture portion is formed, the aperture portion being disposed to oppose a developer-bearing member that retains and conveys a developer while turning, and the aperture portion being long in a direction orthogonal to a conveyance direction of the developer-bearing member;

a recovery member that is disposed along an edge portion of the aperture portion so as to touch against the developer bearing member, the edge portion being at a downstream side of the aperture portion in the conveyance direction, and the recovery member separating the developer from an outer peripheral face of the developer-bearing member and recovering the developer into the casing;

a sealing member that is disposed along an edge portion at a conveyance direction upstream side of the aperture portion so as to touch the developer-bearing member and that seals a gap between the casing and the developer-bearing member;

a moving section that moves the recovery member and the sealing member between a position of being touched against the developer-bearing member and a position of being apart from the developer-bearing member;

a suction section that sucks the developer separated from the developer-bearing member into the casing; and a filter that is long in the length direction of the aperture portion and that is disposed in the casing between the aperture portion and the suction section with an inclination such that a lower portion of the filter is further away from the aperture portion than an upper portion of the filter, wherein, in a state in which the recovery member and the sealing member are apart from the developer-bearing member, an upper end of the filter is disposed at an upper side relative to a lower end of the recovery member.

2. The developer recovery device according to claim 1, wherein a dividing wall stands inside the casing from a bottom portion of the casing, between the aperture portion and the filter.

3. The developer recovery device according to claim 2, wherein, in a state in which the recovery member and the sealing member are moved apart from the developer-bearing member, an upper end of the sealing member is disposed at the upper side relative to an upper end of the dividing wall.

4. The developer recovery device according to claim 2, wherein the suction section is disposed so as to apply suction at a lower side relative to an upper end of the dividing wall.

5. The developer recovery device according to claim 1, wherein the recovery member is disposed upward relative to the sealing member, and the moving section moves the recovery member apart from the developer-bearing member such that a lower end position of the recovery member is disposed at a lower side when moved apart from the developer-bearing member than when touched against the developer-bearing member.

6. An image forming device comprising:

a latent image-bearing body that bears a latent image;

a developing section that develops the latent image on the latent image-bearing body with developer and forms a developer image;

a developer-bearing member to which the developer image on the latent image-bearing body is transferred, the developer-bearing member bearing the developer image;

a transfer section that transfers the developer image on the developer-bearing member to a recording medium; and a developer recovery device according to claim 1 that recovers developer on the developer-bearing member after transfer has been carried out by the transfer section.

* * * * *